US009224296B1

(12) United States Patent
Wu et al.

(10) Patent No.: US 9,224,296 B1
(45) Date of Patent: Dec. 29, 2015

(54) SCHOOL CHILD TRACKING SYSTEM

(76) Inventors: Tian Wu, Madison, AL (US); Li Jiang, Madison, AL (US)

( * ) Notice: Subject to any disclaimer, the term of this patent is extended or adjusted under 35 U.S.C. 154(b) by 1056 days.

(21) Appl. No.: 13/313,625

(22) Filed: Dec. 7, 2011

(51) Int. Cl.
*G08G 1/123* (2006.01)

(52) U.S. Cl.
CPC ..... *G08G 1/123* (2013.01)

(58) Field of Classification Search
CPC ..... G01C 21/343; G06K 17/00; G06K 2017/0045; G07C 9/00071; G08G 1/123
USPC ..... 340/898
See application file for complete search history.

(56) References Cited

U.S. PATENT DOCUMENTS 6,140,939 A * 10/2000 Flick ..... 340/12.28
6,313,744 B1 11/2001 Capowski et al.
6,509,868 B2 * 1/2003 Flick ..... 342/357.395
6,556,903 B2 4/2003 Chinigo et al.
6,992,566 B2 1/2006 Striemer
7,034,683 B2 4/2006 Ghazarian
7,233,240 B2 * 6/2007 Phillips ..... 340/539.13
7,383,123 B2 * 6/2008 Park ..... 701/411
8,594,934 B2 * 11/2013 Oriet ..... 701/491
2004/0203408 A1 10/2004 Wen et al.
2004/0251304 A1 12/2004 Carmon et al.
2005/0131625 A1 6/2005 Birger et al.
2005/0250440 A1 11/2005 Zhou et al.
2007/0152850 A1 * 7/2007 Pechenick et al. ..... 340/988
2007/0171047 A1 7/2007 Goodman et al.
2011/0050463 A1 * 3/2011 Yu et al. ..... 340/993

* cited by examiner

*Primary Examiner* — Brian Zimmerman
*Assistant Examiner* — Bhavin M Patel

(57) ABSTRACT

A system for tracking school buses and schoolchildren to enhance the security and safety of schoolchildren and provide real-time information about the location of students and buses to teachers and administrators and parents by utilizing GPS components and fingerprint scanning technology. In some embodiments, the system is comprised of the following parts: a client software component, hosted on a data storage unit and executed by a client microprocessor.

6 Claims, 3 Drawing Sheets

(In-use View)

SCHOOL CHILD TRACKING SYSTEM

BACKGROUND OF THE INVENTION

The present invention relates to systems, devices and methods for tracking school buses and children who ride the bus to and from school.

SUMMARY

The present invention features a system for tracking schoolchildren and school buses. In some embodiments, the tracking comprises a software component hosted on one or more microprocessors, a software component hosted on a server and located at a main location, a network or wireless connection to link the system to its various locations, a radio network component, a microprocessor located on one or more school buses, a fingerprint scanning component located on one or more school buses, and a GPS component.

Over the past several years, post Columbine and Virginia Tech, parents have grown increasingly concerned about the safety of school children, especially when the school children leave a school campus and traverse back to their respective bus stops. It is believed that the current education system lacks adequate safety systems for the tracking of school children and school buses.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
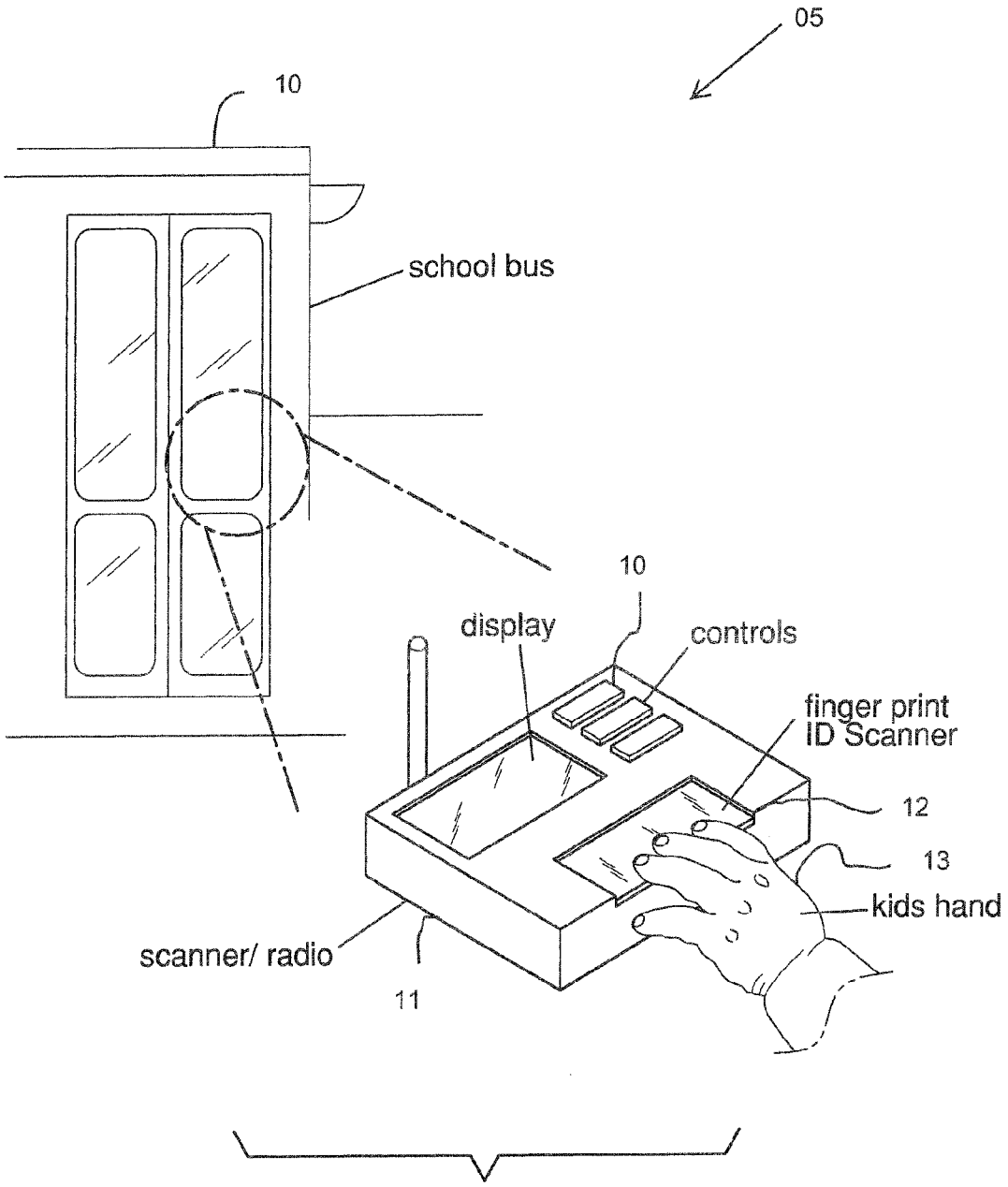
FIG. 1 is a view of the fingerprint input component [05] of the present invention.
Figure 2:
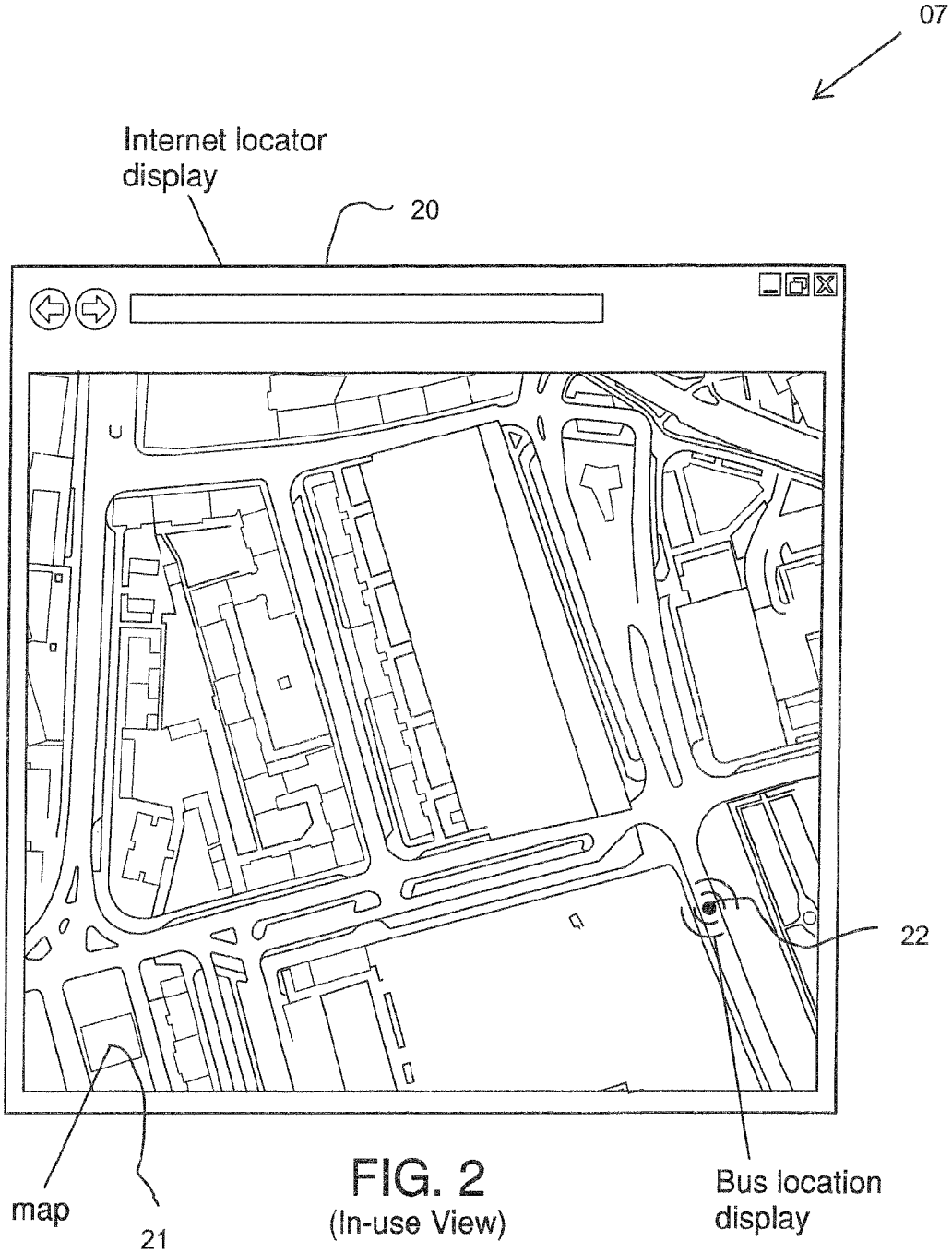
FIG. 2 is an in-use view of the GPS component [07] of the present invention.
Figure 3:
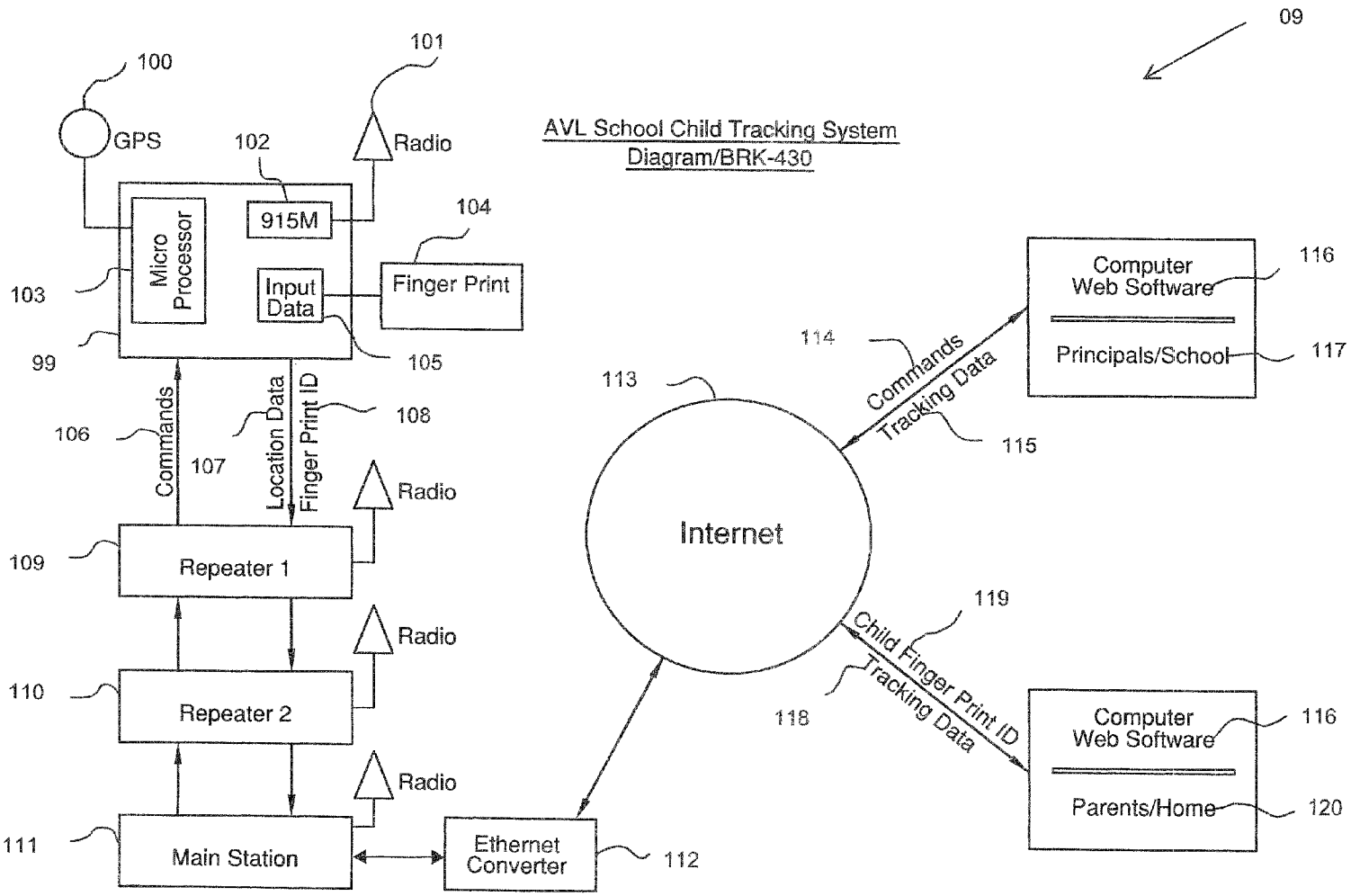
FIG. 3 is a systems view or diagram of the tracking system [09] of the present invention.

Referring now to FIG. 1-3, the present invention, in some embodiments, features a system for tracking school buses [99] and schoolchildren to enhance the security and safety of schoolchildren and provide real-time information about the location of students and school buses, both to [99] to teachers and administrators [117] and parents [120].

In some embodiments, the system is comprised of the following parts.

First, a client software component [116], hosted on a data storage unit and executed by a client microprocessor. The "client" can be a teacher, administrator, [117] or a parent. [120], or any other party such as law enforcement where it would make sense to grant access to said third party for monitoring the system. The client software component [116] provides information to a client about the location of a school bus [99] and schoolchildren by communicating with and receiving data from, over a network [113], a Main Station [111] microprocessor located at a Main Station [111].

Second, a school bus software component, hosted on a school bus microprocessor [103] and further located on the school bus [99]. The school bus software component comprises a set of code instructions that enables the school bus microprocessor [103] to communicate with and transmit data to, using a radio network component [101], the Main Station [111].

Third, a Main Station [111] software component, hosted on the Main Station [111] microprocessor. The Main Station software component is a particular version of the software component that integrates the Main Station into the system. The Main Station [111] software component comprises a set of code instructions that enables the Main Station [111] microprocessor to communicate with and transmit and receive data from, via the radio network component [101], the school bus microprocessor [103], and also whereby the set of code instructions enables the Main Station [111] microprocessor to communicate with and transmit data to one or more of the client microprocessors, over the network [113].

Fourth, the client microprocessor, which can be located on a computer-readable medium such as a personal computer. The client microprocessor can be configured to receive and process data, over the network [113], transmitted by the Main Station [111] microprocessor. The client microprocessor is utilized by a client, such as the teacher or administrators [117] and the parents [120].

Fifth, at least one Global Positioning System ("GPS") component [100], operatively connected to the school bus [99] and the school bus microprocessor [103], and located on the school bus [99]. The GPS component or device can comprise any standard GPS device available on the public market and the GPS component [100] can be configured to transmit real-time geospatial information about the school bus [99] to the Main Station [111] microprocessor.

Sixth, the radio network component [101], which can be a set of multiple parts making up a radio network, comprising the Main Station [111] and the school bus [99], a radio transmitter module [102] located on the school bus, and a set of repeaters [109,110], whereby the radio network component [101] can enable the Main Station to [111] to transmit to and receive information from the school bus [99].

Seventh, a fingerprint scanning component [104], operatively connected to the school bus microprocessor [103] and located on the school bus [99]. The fingerprint scanning component [104] can identify schoolchildren and allow the system to track the boarding of the schoolchildren by recognizing the unique fingerprints of each of the schoolchildren. A schoolchild merely swipes his or her fingerprint each time the child boards the school bus. In some embodiments, the school child can also swipe a fingerprint upon exiting the school bus so parents and teachers are confident that a school child has reached his or her destination.

Eighth, the school bus microprocessor [103], located on the school bus [99], whereby the school bus microprocessor [103] can be configured to execute the school bus software component, receive data from the GPS component [100] and the fingerprint scanning component [104], and transmit said data, via the radio network component [101], to the Main Station [111] microprocessor.

Ninth, the Main Station [111], whereby the Main Station [111] can further comprise the Main Station [111] microprocessor, executing the Main Station [111] software component. The Main Station can act as a central hub for coordinating information between the school buses and the clients. The Main Station can receive data about the school bus [99] via the radio network component [101] and can re-transmit said data to the client microprocessors over the network [113].

The system, in real-time, can generate and track information about the location of a school bus [99] and school children for monitoring of said information by teachers and administrators [117] and parents [120] thereby enhancing the security and safety of school children. A typical application of the system can consist of the following steps: (i) activating a first school bus microprocessor [103] located on a first school bus [99], (ii) scanning the fingerprint of a first student entering the first school bus [99] using the fingerprint scanning component [104], (iii) repeating step (ii) x times, where x=the number of children that board the first school bus [99], (iv) activating the GPS component [100] on the first school bus [99] to allow the system to track the location of the first school bus [99], (v) transmitting information about the number of and identity of school children on the first school bus [99] and the location of the first school bus [99] from the school bus microprocessor [103] to the Main Station [111] microprocessor, via the radio network component [101], (vi) re-transmitting said information, over the network [113], about the number of and identity of school children on the first school bus [99] and the location of the first school bus [99] from the Main Station microprocessor [111] to one or more of the client microprocessors, and (vii) repeating steps (i) through (v) y amount of times, where y=the total number of school buses within the system.

The present invention, in some embodiments, is a proposed security system for schools to provide for real-time tracking and audit-trial documentation of boarding and exiting of school children on and movement of a school bus.

Unlike the prior art which mainly proposes the use of sensors or mobile devices to track the location of school children when boarding or exiting a school bus, in one embodiment, the present invention utilizes a novel system of finger print scanning components which are configured such that a student can swipe a finger and be identified and tracked when boarding or exiting a school bus. It is believed that this system is advantageous and novel over the prior art because this tracking system does not require school children to carry around mobile devices and does not require the expensive placement of multiple sensors on a school bus.

In one embodiment, the present invention utilizes a fingerprint scanner, together with other data collection components and wired or wireless equipment to create a record of every school child that boards a school bus and providing real-time information about the speed, and location of a school bus that the school children have boarded.

As used herein, the term "student" is used interchangeably with and also refers to a "school child".

While the claims refer to "teachers and administrators" or "parents" being the clients utilizing a client microprocessor for receiving information about the school buses and school children, the present invention is not limited to these categories and could comprise a number of different clients including for example, law enforcement.

As recited in the claim language, the radio transmitter module can be a 915 m radio transmitter module which uses the 915 megahertz frequency. The 915 megahertz frequency does not require an FCC license.

As recited in the claim language, a repeater is another transmitter that collects data from the 915 m transmitter module and repeats it to provide greater range of coverage. In some embodiments the present invention utilizes multiple repeaters.

As recited in the claim language, the Main Station is the device where all the data is eventually gathered from the repeaters. The Main Station can be configured to process the data it receives from the radio transmitter modules located on the individual schoolbuses, and then the Main Station can send the data to the internet server for the parent and teachers use.

As used herein, the term "about" refers to plus or minus 10% of the referenced number.

As used herein, the term "about" refers to plus or minus 10% of the referenced number. For eXample, an embodiment wherein the device is about 10 inches in length includes a device that is between 9 and 11 inches in length.

The disclosures of the following U.S. Patents are incorporated in their entirety by reference herein: U.S. Pat. No. 6,556,903; U.S. Pat. No. 6,992,566; U.S. Pat. No. 7,034,683; U.S Patent Application No. 2004-0203408; US Patent Application No. 2004-0251304; US Patent Application No. 2005-0131625; US Patent Application No. 2005-0250440; and US Patent Application No. 2007-0171047.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A system for tracking school buses [99] and schoolchildren to enhance the security and safety of schoolchildren and provide real-time information about the location of students and school buses [99] to teachers and administrators [117] and parents [120], the system comprising:

a. at least one instance of a client software component [116], hosted on a data storage unit and executed by one or more client microprocessors, whereby the client software component comprises a set of code instructions that enables one or more teachers and administrators [117] or one or more parents [120] to track the location of at least one school bus [99] and a schoolchild by communicating with and receiving data from, over a network [113], a Main Station [111] microprocessor located at a Main Station [111];

b. at least one instance of a school bus software component, hosted on a school bus microprocessor [103] and further located on the school bus [99], whereby the school bus software component comprises a set of code instructions that enables the school bus microprocessor [103] to communicate with and transmit data to, using a radio network component [101], the Main Station [111]; wherein the radio network component [101] comprises a radio transmitter module [102] located on the school bus, and a set of repeaters [109, 110], wherein the radio transmitter module is a 915 megahertz radio transmitter module which uses the 915 megahertz frequency, wherein a repeater collects data from the 915 megahertz transmitter module and repeats it to provide greater range of coverage;

c. a Main Station [111] software component, hosted on the Main Station [111] microprocessor, whereby the Main Station [111] software component comprises a set of code instructions that enables the Main Station [111] microprocessor to communicate with and transmit and receive data from, via the radio network component [101], the school bus microprocessor [103], and also whereby the set of code instructions enables the Main Station [111] microprocessor to communicate with and transmit data to one or more of the client microprocessors, over the network [113];

d. that at least one client microprocessor, located on a computer-readable medium, whereby the client microprocessor is configured to receive data, over the network [113], transmitted by the Main Station [111] microprocessor, and whereby the client microprocessor is utilized by the teacher or administrators and the parents [120];

e. at least one Global Positioning System ("GPS") component [100], operatively connected to the school bus [99] and the school bus microprocessor [103], and located on the school bus [99], whereby the GPS component [100] is configured to transmit real-time geospatial information about the school bus [99] to the Main Station [111] microprocessor;

f. the radio network component [101], comprising the Main Station [111] and the school bus [99], whereby the radio network component [101] further comprises a radio transmitter module [102] located on the school bus, and a set of repeaters [109,110], whereby the radio network component [101] enables the existence of a radio network which permits the Main Station [111] to transmit to and receive information from the school bus [99];

g. a fingerprint scanning component [104], operatively connected to the school bus microprocessor [103] and located on the school bus [99], whereby the fingerprint scanning component [104] identifies and tracks the boarding of the schoolchildren corresponding to the unique fingerprints of each of the schoolchildren;

h. that at least one school bus microprocessor [103], located on the school bus [99], whereby the school bus microprocessor [103] is configured to execute the school bus software component, receive data from the GPS component [100] and the fingerprint scanning component [104], and transmit said data, via the radio network component [101], to the Main Station [111] microprocessor;

i. the Main Station [111], whereby the Main Station [111] further comprises the Main Station [111] microprocessor, executing the Main Station [111] software component and whereby the Main Station receives data about the school bus [99] via the radio network component [101] and can re-transmit said data to the client microprocessors over the network [113];

whereby the system, in real-time, generates and tracks information about the location of the school bus [99] and school children for monitoring of said information by teachers and administrators [117] and parents [120] thereby enhancing the security and safety of school children, the system further comprising the following steps:

(i) activating a first school bus microprocessor [103] located on a first school bus [99];

(ii) scanning the fingerprint of a first student entering the first school bus [99] using the fingerprint scanning component [104];

(iii) repeating step (ii) x times, where x=the number of children that board the first school bus [99];

(iv) activating the GPS component [100] on the first school bus [99] to allow the system to track the location of the first school bus [99];

(v) transmitting information about the number of and identity of school children on the first school bus [99] and the location of the first school bus [99] from the school bus microprocessor [103] to the Main Station [111] microprocessor, via the radio network component [101] which permits the main station [111] to transmit to and receive information from the school bus [99];

(vi) re-transmitting said information, over the network [113], about the number of and identity of school children on the first school bus [99] and the location of the first school bus [99] from the Main Station microprocessor [111] to one or more of the client microprocessors, and (vii) repeating steps (i) through (v) y amount of times, where y=the total number of school buses within the system.

2. The system of claim 1, whereby the system further comprises a motion sensor component located on one or more school buses [99] where by the motion sensor component is configured to direct the school bus microprocessor [103] to send a command, over the radio network [101], to the Main Station [111] microprocessor indicating that the school bus [99] is or is not in motion.

3. The system of claim 1, whereby the client software component comprises a mobile application hosted on a cell phone or other mobile device.

4. The system of claim 1, whereby the fingerprint scanning component [104] and the GPS component [100] are further configured such that upon a school child exiting the school bus [99], the school child interacts with the fingerprint scanning component [104] a second time, thereby generating information for the school bus microprocessor [103] for further transmittal to the parent or teacher [117] about when a school child exits and where.

5. The motion sensor of claim 2, whereby the system sends an alert to a Main Station [111] when the motion sensor determines that the school bus [99] is not moving.

6. A system for tracking school buses [99] and schoolchildren to enhance the security and safety of schoolchildren and provide real-time information about the location of students and school buses [99] to teachers and administrators [117] and parents [120], the system consisting of:

a. at least one instance of a client software component [116], hosted on a data storage unit and executed by one or more client microprocessors, whereby the client software component consisting of a set of code instructions that enables one or more teachers and administrators [117] or one or more parents [120] to track the location of at least one school bus [99] and a schoolchild by communicating with and receiving data from, over a network [113], a Main Station [111] microprocessor located at a Main Station [111];

b. at least one instance of a school bus software component, hosted on a school bus microprocessor [103] and further located on the school bus [99], whereby the school bus software component consisting of a set of code instructions that enables the school bus microprocessor [103] to communicate with and transmit data to, using a radio network component [101], the Main Station [111]; wherein the radio network component [101] consisting of a radio transmitter module [102] located on the school bus, and a set of repeaters [109, 110], wherein the radio transmitter module is a 915 megahertz radio transmitter module which uses the 915 megahertz frequency, wherein a repeater collects data from the 915 megahertz transmitter module and repeats it to provide greater range of coverage;

c. a Main Station [111] software component, hosted on the Main Station [111] microprocessor, whereby the Main Station [111] software component consisting of a set of code instructions that enables the Main Station [111] microprocessor to communicate with and transmit and receive data from, via the radio network component [101], the school bus microprocessor [103], and also whereby the set of code instructions enables the Main Station [111] microprocessor to communicate with and transmit data to one or more of the client microprocessors, over the network [113];

d. that at least one client microprocessor, located on a computer-readable medium, whereby the client microprocessor is configured to receive data, over the network [113], transmitted by the Main Station [111] microprocessor, and whereby the client microprocessor is utilized by the teacher or administrators [117] and the parents [120];

e. at least one Global Positioning System ("GPS") component [100], operatively connected to the school bus [99] and the school bus microprocessor [103], and located on the school bus [99], whereby the GPS component [100] is configured to transmit real-time geospatial information about the school bus [99] to the Main Station [111] microprocessor;

f. the radio network component [101], consisting of the Main Station [111] and the school bus [99], whereby the radio network component [101] further consisting of a radio transmitter module [102] located on the school bus, and a set of repeaters [109,110], whereby the radio network component [101] enables the existence of a radio network which permits the Main Station [111] to transmit to and receive information from the school bus [99];

g. a fingerprint scanning component [104], operatively connected to the school bus microprocessor [103] and located on the school bus [99], whereby the fingerprint scanning component [104] identifies and tracks the boarding of the schoolchildren corresponding to the unique fingerprints of each of the schoolchildren;

h. that at least one school bus microprocessor [103], located on the school bus [99], whereby the school bus microprocessor [103] is configured to execute the school bus software component, receive data from the GPS component [100] and the fingerprint scanning component [104], and transmit said data, via the radio network component [101], to the Main Station [111] microprocessor;

i. the Main Station [111], whereby the Main Station [111] further consisting of the Main Station [111] microprocessor, executing the Main Station [111] software component and whereby the Main Station receives data about the school bus [99] via the radio network component [101] and can re-transmit said data to the client microprocessors over the network [113];

whereby the system, in real-time, generates and tracks information about the location of the school bus [99] and school children for monitoring of said information by teachers and administrators [117] and parents [120] thereby enhancing the security and safety of school children, the system further consisting of the following steps:

(i) activating a first school bus microprocessor [103] located on a first school bus [99];

(ii) scanning the fingerprint of a first student entering the first school bus [99] using the fingerprint scanning component [104];

(iii) repeating step (ii) x times, where x=the number of children that board the first school bus [99];

(iv) activating the GPS component [100] on the first school bus [99] to allow the system to track the location of the first school bus [99];

(v) transmitting information about the number of and identity of school children on the first school bus [99] and the location of the first school bus [99] from the school bus microprocessor [103] to the Main Station [111] microprocessor, via the radio network component [101] which permits the main station [111] to transmit to and receive information from the school bus [99];

(vi) re-transmitting said information, over the network [113], about the number of and identity of school children on the first school bus [99] and the location of the first school bus [99] from the Main Station microprocessor [111] to one or more of the client microprocessors, and (vii) repeating steps (i) through (v) y amount of times, where y=the total number of school buses within the system.

* * * * *